US011781739B2

(12) United States Patent
Elmore et al.

(10) Patent No.: US 11,781,739 B2
(45) Date of Patent: Oct. 10, 2023

(54) PERIMETER LUMINAIRE

(71) Applicant: HLI Solutions, Inc., Greenville, SC (US)

(72) Inventors: Mark V. Elmore, Easley, SC (US); Douglas S. Hodges, Anderson, SC (US); Russell J. Weston, Greer, SC (US)

(73) Assignee: HLI Solutions, Inc., Greenville, SC (US)

( * ) Notice: Subject to any disclaimer, the term of this patent is extended or adjusted under 35 U.S.C. 154(b) by 0 days.

(21) Appl. No.: 17/340,504

(22) Filed: Jun. 7, 2021

(65) Prior Publication Data

US 2021/0293397 A1 Sep. 23, 2021

Related U.S. Application Data

(63) Continuation of application No. 15/454,525, filed on Mar. 9, 2017, now Pat. No. 11,028,999.

(60) Provisional application No. 62/305,822, filed on Mar. 9, 2016.

(51) Int. Cl.

| | |
|---|---|
| ***F21V 15/01*** | (2006.01) |
| ***F21V 29/75*** | (2015.01) |
| ***F21V 23/00*** | (2015.01) |
| ***F21V 31/00*** | (2006.01) |
| *F21Y 115/10* | (2016.01) |
| *F21W 131/107* | (2006.01) |

(52) U.S. Cl.

CPC ..... *F21V 15/01* (2013.01); *F21V 23/003* (2013.01); *F21V 29/75* (2015.01); *F21V 31/005* (2013.01); *F21W 2131/107* (2013.01); *F21Y 2115/10* (2016.08)

(58) Field of Classification Search

CPC ..... F21V 15/01; F21V 15/012; F21V 29/75; F21V 23/003; F21V 31/005; F21V 23/0464; F21V 23/0471; F21S 13/10; F21S 8/085

See application file for complete search history.

(56) References Cited

U.S. PATENT DOCUMENTS

| | | | |
|---|---|---|---|
| 8,419,217 | B2 | 4/2013 | Lu et al. |
| 8,506,127 | B2 | 8/2013 | Russello et al. |
| 8,814,398 | B2 | 8/2014 | Kang et al. |
| 9,121,580 | B1 | 9/2015 | Bryant |
| 9,777,911 | B2 * | 10/2017 | Duckworth ..... F21V 15/01 |

(Continued)

FOREIGN PATENT DOCUMENTS

| | | |
|---|---|---|
| EP | 2187121 | 5/2010 |
| EP | 2784384 | 10/2014 |
| WO | 2012095019 | 7/2012 |

OTHER PUBLICATIONS

PCT/US20217/021567 International Search Report and Written Opinion dated May 26, 2017 (13 pages).

(Continued)

*Primary Examiner* — Christopher E Dunay
(74) *Attorney, Agent, or Firm* — Michael Best & Friedrich LLP

(57) ABSTRACT

A luminaire includes a housing containing a control component. A cover is connected to the housing having an outer wall, a mounting section, and a chamber. A divider is positioned between the housing and the cover and includes a conductor opening. A light assembly is connected to the mounting section and operatively connected to the control component.

20 Claims, 10 Drawing Sheets

(56) References Cited

U.S. PATENT DOCUMENTS

2010/0128479 A1 5/2010 Biebl
2011/0068708 A1 3/2011 Coplin et al.
2011/0176316 A1 7/2011 Phipps
2011/0305027 A1* 12/2011 Ham ..... F21V 19/009 362/373
2012/0087118 A1* 4/2012 Bailey ..... F21V 15/015 362/373
2012/0250311 A1 10/2012 Luegge
2012/0325982 A1 12/2012 Guercio
2013/0049591 A1 2/2013 Quercia et al.
2013/0083522 A1* 4/2013 Bowers ..... F21V 29/763 362/249.02
2013/0134880 A1 5/2013 Rea
2013/0155673 A1 6/2013 Wang
2013/0329405 A1 12/2013 Chow
2014/0085902 A1 3/2014 Higuchi et al.
2014/0133138 A1* 5/2014 Chang ..... F21V 3/00 362/183
2014/0240983 A1* 8/2014 Lu ..... F21K 9/20 362/249.02
2015/0036387 A1 2/2015 Myers
2015/0109820 A1 4/2015 Wilcox et al.
2015/0345772 A1* 12/2015 Duckworth ..... F21V 17/06 362/373
2016/0186970 A1 6/2016 Sorenson
2017/0102140 A1 4/2017 Bailey
2017/0276306 A1 9/2017 Newton
2017/0307204 A1 10/2017 Cattoni
2018/0080639 A1* 3/2018 Papai ..... F21V 21/14
2018/0128476 A1* 5/2018 Sokolov ..... F21V 31/005
2018/0172243 A1* 6/2018 Clynne ..... H04W 84/18
2020/0284414 A1* 9/2020 Erel ..... F21V 23/008

OTHER PUBLICATIONS

Canadian Patent Office Action for Application No. 3,017,193 dated Apr. 6, 2023 (3 pages).

* cited by examiner

PERIMETER LUMINAIRE

RELATED APPLICATION(S)

This application is a continuation of U.S. patent application Ser. No. 15/454,525, filed Mar. 9, 2017, which is based on U.S. Provisional Application Ser. No. 62/305,822, filed Mar. 9, 2016, the disclosures of which are incorporated herein by reference in their entirety and to which priority is claimed.

FIELD

Various exemplary embodiments relate to luminaires and components for luminaires.

BACKGROUND

Light fixtures, or luminaires, are used with electric light sources to provide an aesthetic and functional housing in both interior and exterior applications. One type of light fixture is an area light, generally used for exterior lighting of buildings, walkways, parks, and parking lots, and interior applications such as hallways, warehouses, entryways, or other areas. Area lights typically include a light fixture attached to a pole, wall, or other elevated structure to provide an elevated lighting position. In recent years, lighting applications, including area lights have trended towards the use of light emitting diodes (LEDs) as a light source in place of conventional incandescent and fluorescent lamps.

SUMMARY

According to an exemplary embodiment, a luminaire includes a housing for containing a control component. A cover is connected to the housing having an outer wall, a mounting section, and a chamber including a set of heat fins in thermal communication with the mounting section. A divider is positioned between the housing and the cover and includes a conductor opening. A light assembly is connected to the mounting section and operatively connected to the control component.

According to another exemplary embodiment, a luminaire includes a housing for containing a control component. A cover is connected to the housing having an outer wall, a mounting section, a chamber, and a conductor channel positioned in the chamber. The conductor channel has an opening in communication with the mounting section. A divider is positioned between the housing and the cover and includes a conductor opening. A light assembly is connected to the mounting section and operatively connected to the control component.

According to another exemplary embodiment, a luminaire includes a housing having a back wall, a top wall, a bottom wall, a pair of side walls, and an open front. A cover is connected to the housing having an outer wall, a mounting section, and a chamber. A divider is positioned between the housing and the cover and includes a conductor opening providing communication between the cover and the housing. A control assembly is positioned in the housing. A light assembly is connected to the mounting section and operatively connected to the control assembly.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Various exemplary embodiments of this application are directed to luminaires, for example indoor and outdoor area lighting luminaires. The luminaires allow for mounting and housing of different components as required for different applications using similar elements. For example, common housings or mounting features can accommodate different configurations of luminaires that include one or more different types of light emitters, drivers, surge protectors, fuses, photocells, occupancy sensors, wireless communication devices, covers, and lenses. The luminaires also provide efficient thermal management across the range of configurations. This allows customers to customize the luminaire to a desired architectural design within the same product line.

FIGS. 1-4 show an exemplary embodiment of a luminaire having a housing 10, a cover 12, and a light assembly 14. The housing 10 can contain one or more control components. The housing 10 and cover 12 can have a variety of shapes, sizes, and configurations and be made from a variety of materials including metals, polymers, composites, and other suitable materials. The housing 10 and the cover 12 are each shown as single-piece, unitary structures, although they can also be composed of multiple pieces that are connected together. The control components can include a variety of different components, including any combination of drivers, surge protectors, fuses, photocells, occupancy sensors, and wireless communication devices. Different control components and assemblies are shown and described in U.S. patent application Ser. No. 14/984,827, the entire disclosure of which is incorporated herein by reference. The light assembly 14 includes one or more light emitting devices.

Figure 5:
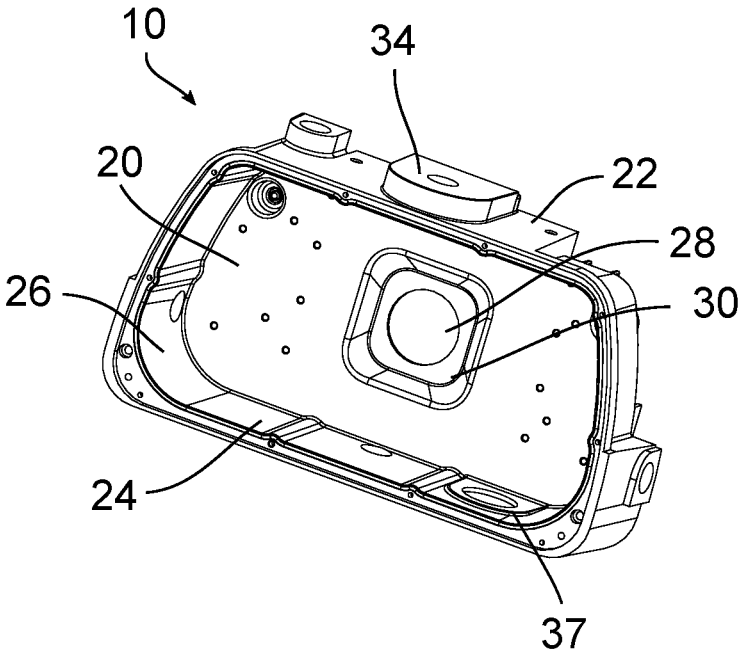
FIG. 5 is front perspective view of the housing of FIG. 1.
Figure 6:
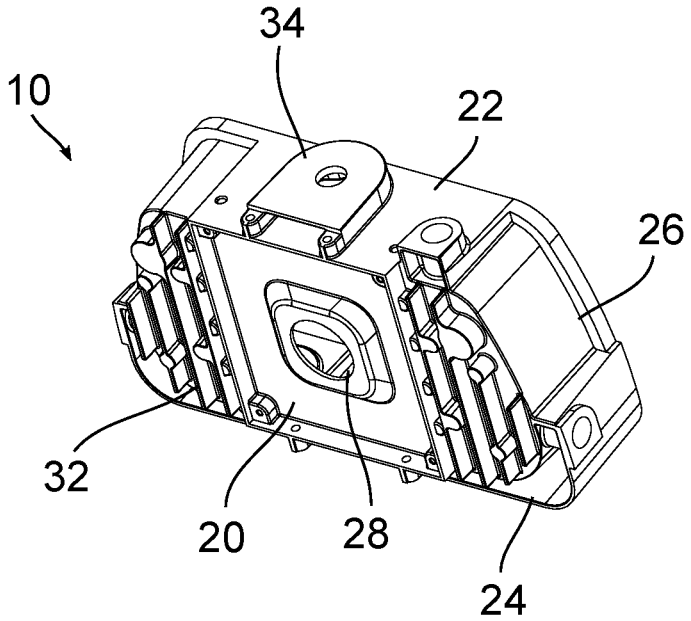
FIG. 6 is a rear perspective view of FIG. 5.

FIGS. 5 and 6 show an exemplary embodiment of a housing 10. The housing 10 has a back wall 20, a top wall 22, a bottom wall 24, and a pair of side walls 26 that surround a cavity that can receive one or more control components. A number of openings are provided in the housing to receive fasteners, seals, and components of the control assembly. A conductor opening 28 is provided in the back wall 20 and a recessed area 30 is formed around the conductor opening 28. More than one conductor opening can be provided in various locations on the housing 10. Knock-outs may be used to provide selective openings for conductors and other components. One or more fins 32 or other projections extend from the back wall 24 to increase the heat transfer from the housing 10. The housing 10 can also include structural features that allow one or more sensors to be connected to the housing. For example a protrusion 34 with an opening extends from the top wall 22 and can connect to a sensor, for example a photo-controller 36 and a protrusion 37 with an opening is provided on the bottom wall 24 for receiving an occupancy sensor 38.

Figure 7:
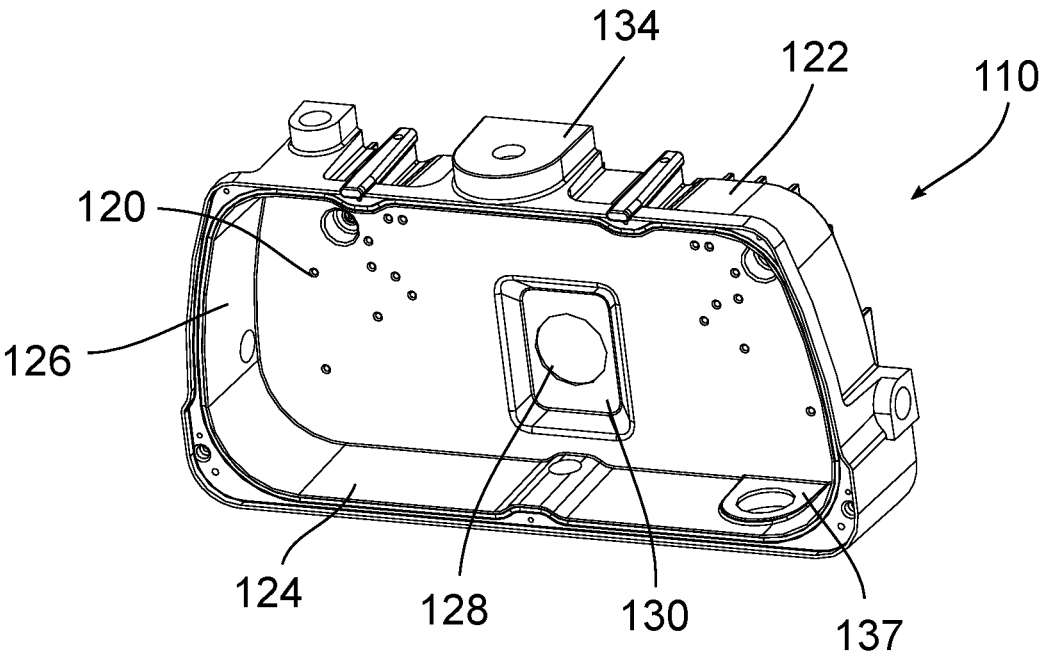
FIG. 7 is a front perspective view of another exemplary housing.
Figure 8:
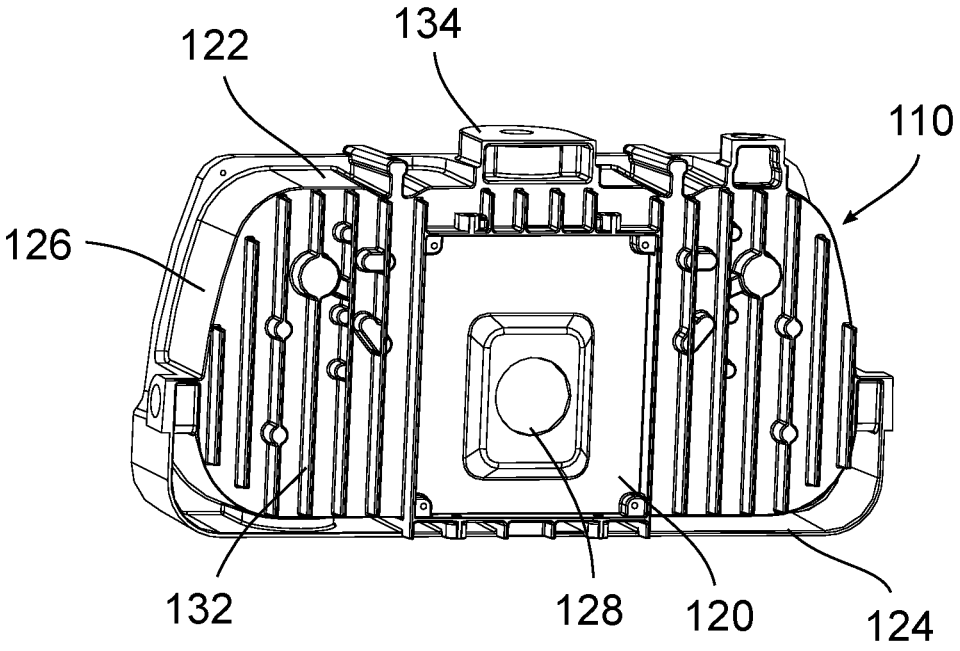
FIG. 8 is a rear perspective view of FIG. 7.

FIGS. 7 and 8 show an alternative configuration of an exemplary housing 110 that is larger than the housing 10 shown in FIGS. 5 and 6. The larger housing 110 can be configured for a higher light output, receiving more or larger control components than those associated with the smaller housing 10. The housing 110 has a back wall 120, a top wall 122, a bottom wall 124, and a pair of side walls 126 that surround a cavity that can receive one or more control components. A number of openings are provided in the housing to receive fasteners, seals, and components of the control assembly. A conductor opening 128 is provided in the back wall 120 and a recessed area 130 is formed around the conductor opening 128. More than one conductor opening can be provided in various locations on the housing 110. Knock-outs may be used to provide selective openings for conductors and other components. One or more fins 132 or other projections extend from the back wall 124 to increase the heat transfer from the housing 110. The housing 110 can also include structural features that allow one or more sensors to be connected to the housing. For example a protrusion 134 with an opening extends from the top wall 122 and can connect to a sensor, for example a photo-controller and a protrusion 137 with an opening can be provided on the bottom wall 124 for receiving an occupancy sensor.

A variety of components and configurations can be used in connection with the luminaire as desired by a user. Exemplary control assemblies can utilize a photo-detector 36 and a motion or occupancy sensor 38 positioned in and extending through the housing 10. Additional and alternative sensors can be used as would be understood by one of ordinary skill in the art.

Figure 1:
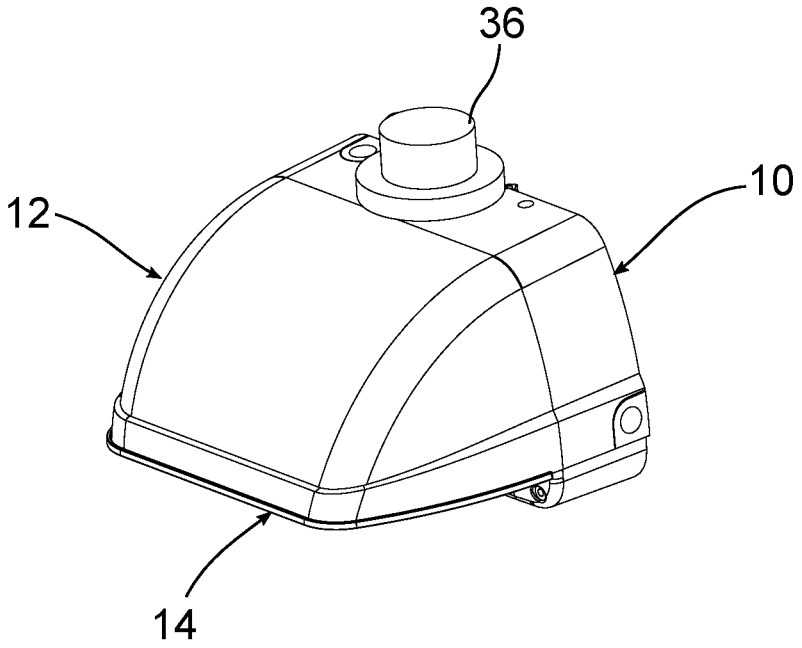
FIG. 1 is a top perspective view of an exemplary luminaire.
Figure 2:
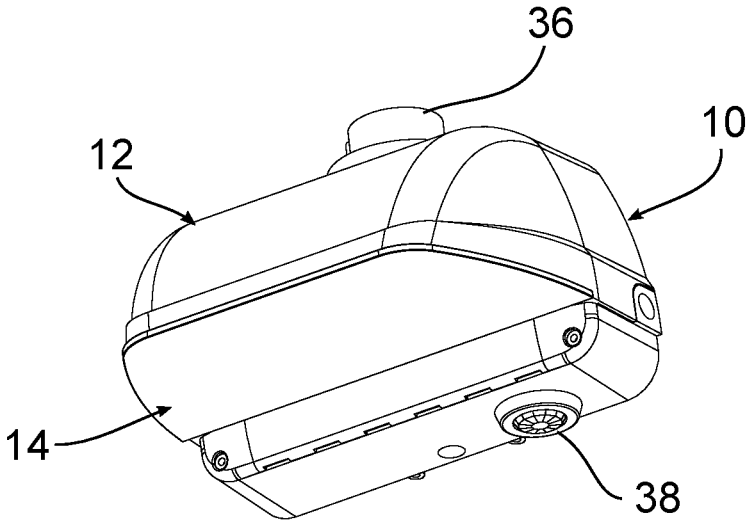
FIG. 2 is a bottom perspective view of FIG. 1.
Figure 3:
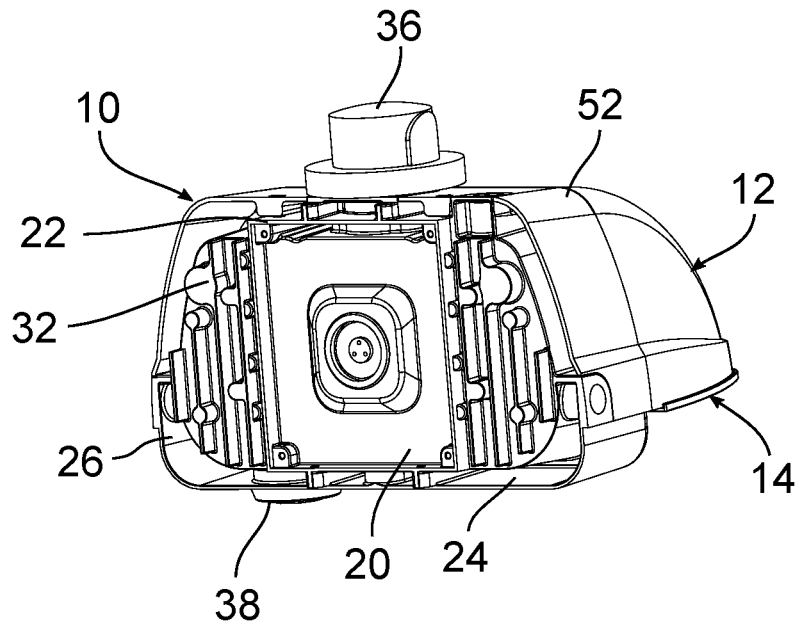
FIG. 3 is a rear perspective view of FIG. 1.
Figure 4:
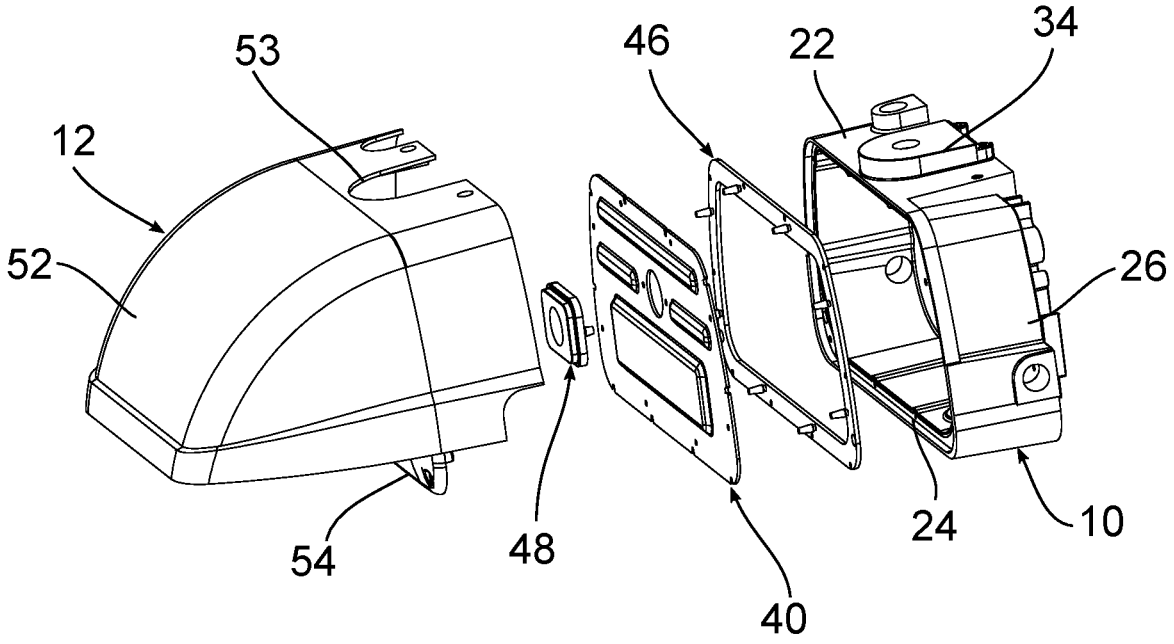
FIG. 4 is an exploded view of FIG. 1.
Figure 9:
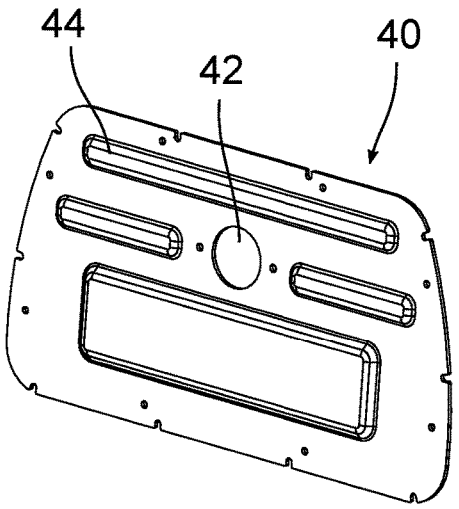
FIG. 9 is a front perspective view of the exemplary divider shown in FIG. 3.

In an exemplary embodiment, a divider 40 is positioned between the housing 10 and the cover 12. The divider 40 forms a barrier between the housing 10 and the cover 12. As best shown in FIGS. 4 and 9, the exemplary divider 40 has a substantially plate configuration with a central opening 42 and or more depressions 44. The opening 42 allows conductors to pass from the housing 10 to the cover 12. The depressions 44 provide space for control components positioned in the housing 10. The divider 40 can be made from a rigid material, for example stamped sheet metal.

Figure 10:
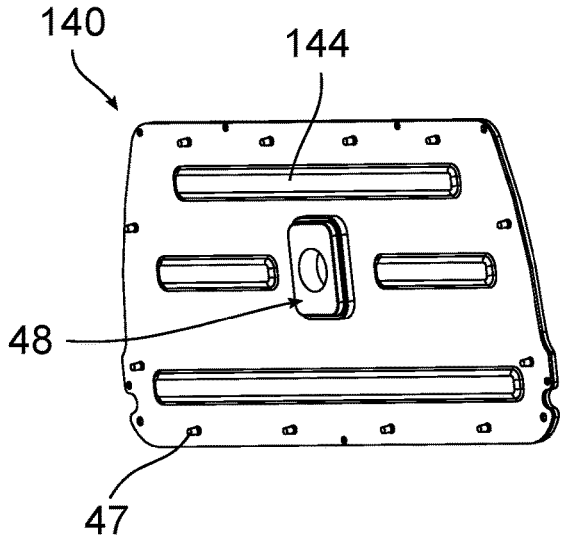
FIG. 10 is a front perspective view of another exemplary divider with an outer gasket and a conductor gasket.
Figure 11:
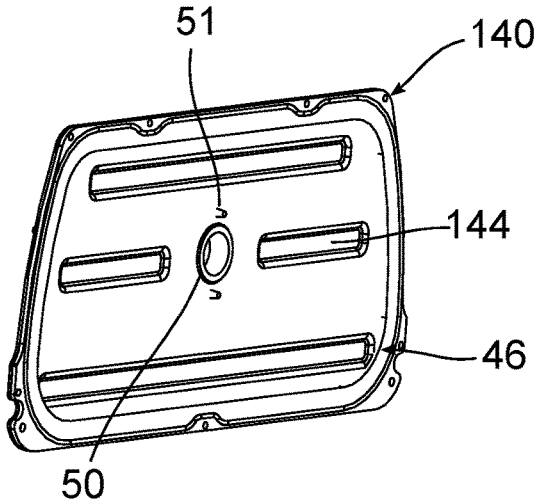
FIG. 11 is a rear perspective view of FIG. 10.
Figure 12:
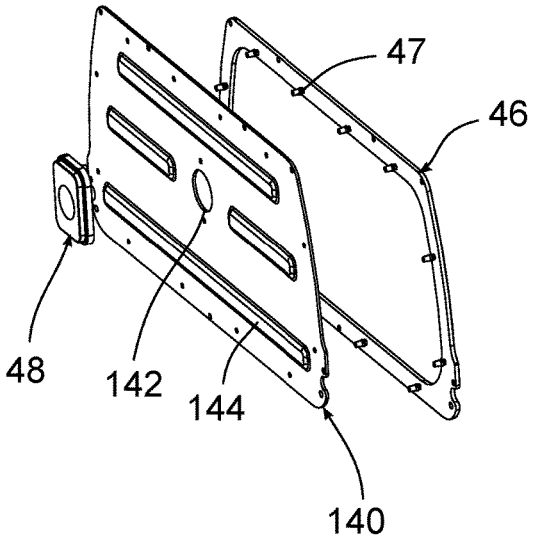
FIG. 12 is a front perspective, exploded view of FIG. 10.
Figure 13:
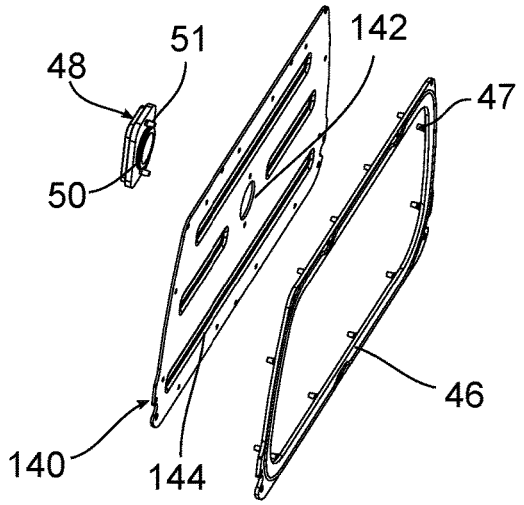
FIG. 13 is a rear perspective, exploded view of FIG. 12.
Figure 14:
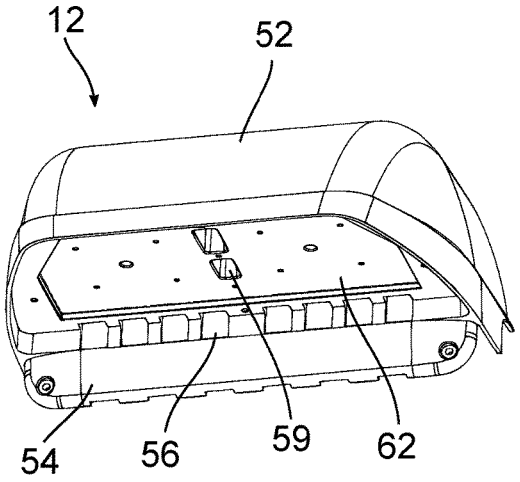
FIG. 14 is front perspective view of the cover of FIG. 1.
Figure 15:
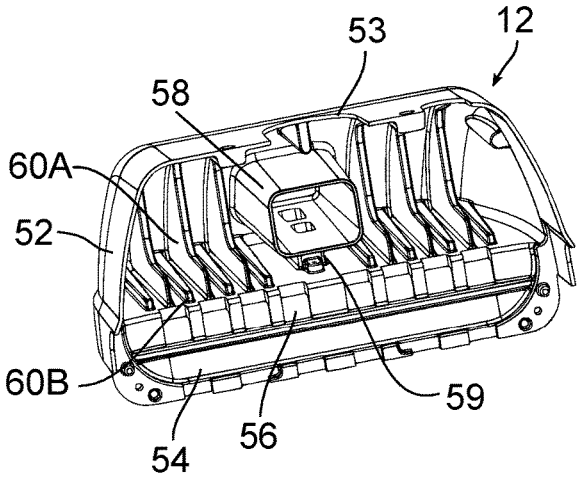
FIG. 15 is a rear perspective view of FIG. 14.

FIGS. 10-13 show another exemplary divider 140. In an exemplary embodiment, the divider 140 shown in FIGS. 10-12 is used with the housing 110 shown in FIGS. 7 and 8. The divider 140 has a substantially plate configuration with a central opening 142 and or more depressions 144. The opening 142 allows conductors to pass from the housing 110. The depressions 144 provide space for control components positioned in the housing 10, for example one or more drivers. The divider 140 can be made from a rigid material, for example stamped sheet metal.

An outer gasket 46 and a conductor gasket 48 can be associated with the divider 40. The outer gasket 46 is positioned with the divider 40 in a groove of the housing 10, with the outer gasket 46 positioned adjacent the housing 10 and the divider 40 positioned adjacent the cover 12. One or more projections 47 extend from the outer gasket 46 through the divider 40 and into the cover 12. In an exemplary embodiment, the outer gasket 46 and the divider 40 form a weather tight seal. The conductor gasket 48 is connected to the conductor opening 42 in the divider 40 and includes a flange 50 that extends into the conductor opening 42 and one or more projections 51 that extend through the divider 40.

According to an exemplary embodiment, the cover 12 includes an outer wall 52 having a curved front portion, a top edge, rounded corners, and angled sides that enclose a chamber. At least a portion of the cover 12 overlaps with the top wall 22 of the housing 10 and the outer wall 52 includes a slot 53 for mating with the protrusion 34 on the top wall 22 of the housing 10. The cover 12 includes a mounting flange 54 to assist in connecting the cover 12 to the housing 10. One or more openings 56 can be provided in the mounting flange 54 to act as vents for increased airflow.

A conductor channel 58 extends through a portion of the chamber. For example, the conductor channel 58 can extend from a front portion of the outer wall back toward the housing 12. The conductor channel 58 includes one or more openings for allowing conductors to pass through the channel and connect to the light emitter assembly 14. In an exemplary embodiment, the conductor channel 58 includes a top wall, a bottom wall, and a pair of side walls, and openings are provided in the bottom wall. One or more passage members 59 can be provided between the conductor channel and portion of the cover 12 receiving the light emitter 14, for example the lower surface of the chamber, so that conductors extending through the conductor channel and to the light emitter 14 are enclosed. The conductor channel 58 receives at least a portion of the conductor gasket 48 connected to the divider 40.

Positioned in the chamber are a plurality of fins 60A, 60B to transfer heat from the light assembly to the exterior of the cover 12. In an exemplary embodiment, the fins include alternating major fins 60A and minor fins 60B. The major fins 60A are larger than the minor fins 60B. For example, the major fins 60A can extend from a lower surface of the chamber to a top surface of the chamber and along the front portion of the interior of the outer wall 52, providing direct thermal communication from the light emitter assembly 14 to the outer wall 52 and the exterior of the cover 12. The minor fins 60B can extend half the height or less than the major fins 60A. The major fins 60A can also include a lower portion that extends toward the rear of the cover a greater distance than an upper portion. According to various exemplary embodiments, the major fins 60A are aligned with the openings 56. Any combination of these features helps to increase heat transfer and airflow in the chamber.

The cover 12 also includes a mounting section 62 for receiving at least a portion of the light assembly 14. One or more openings can extend through the mounting section 62 to receive fasteners that connect the light assembly 14 to the mounting section 62. There are also openings that align with the openings in the passage member 59 and the conductor channel 58. In an exemplary embodiment, the mounting section 62 is recessed to receive the light assembly 14.

Figure 16:
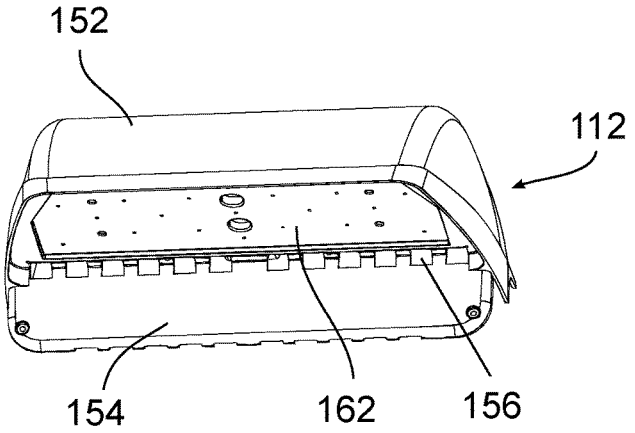
FIG. 16 is a front perspective view of another exemplary cover.
Figure 17:
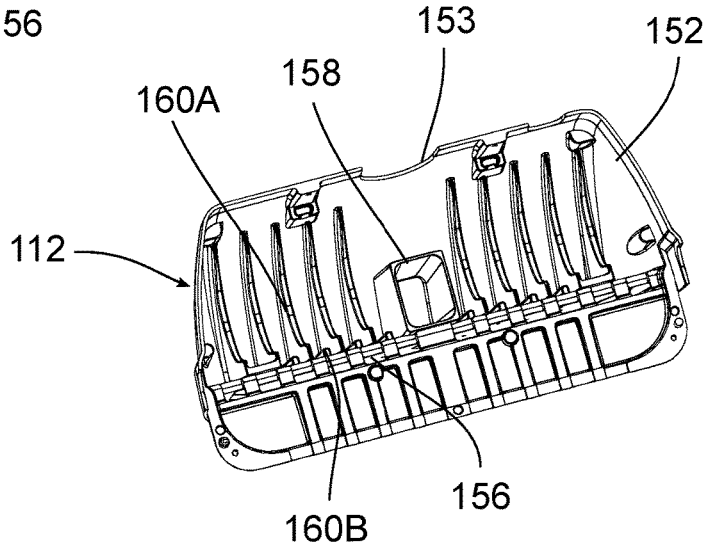
FIG. 17 is a rear perspective view of FIG. 16.
Figure 18:
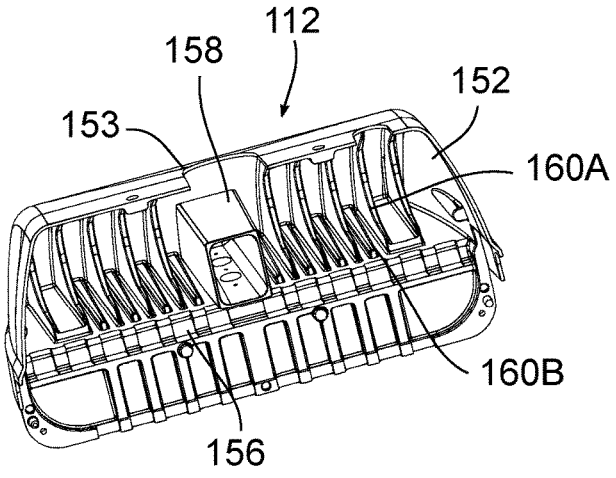
FIG. 18 is a rear perspective view of FIG. 16.

FIGS. 16-18 show another exemplary cover 112 having similar components. In an exemplary embodiment, the cover 112 shown in FIGS. 16-18 is used with the housing 110 shown in FIGS. 7 and 8. According to an exemplary embodiment, the cover 112 includes an outer wall 152 having a curved front portion, a top edge, rounded corners, and angled sides that enclose a chamber. At least a portion of the cover 112 overlaps with the top wall 122 of the housing 110 and the outer wall 152 includes a slot 153 for mating with the protrusion 134 on the top wall 122 of the housing 110. The cover 112 includes a mounting flange 54 to assist in connecting the cover 112 to the housing 110. One or more openings 156 can be provided in the mounting flange 154 to act as vents for increased airflow. The cover 112 also includes a conductor channel and as set of fins 160A, 160B.

Figure 19:
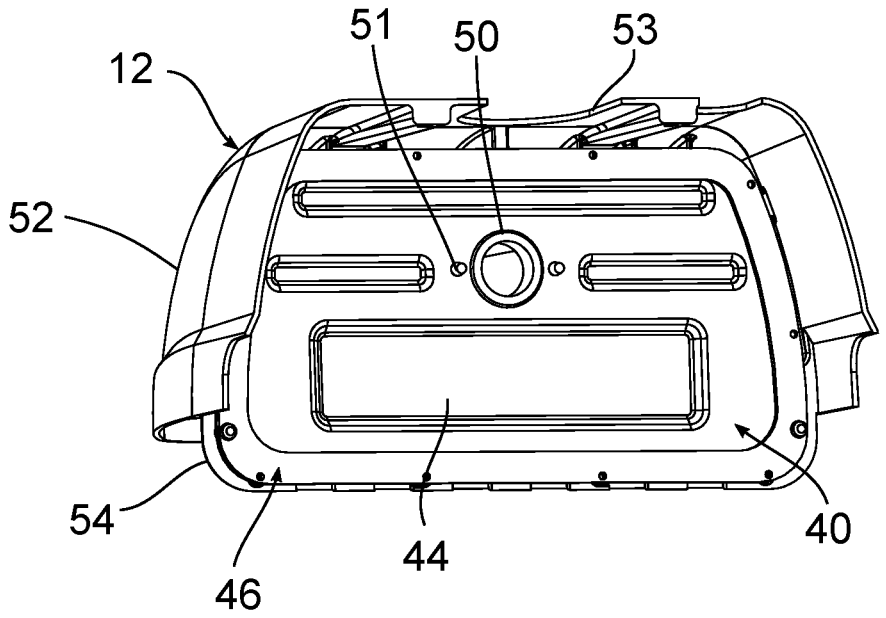
FIG. 19 is a rear perspective view of the cover, divider, outer gasket, and conductor gasket of FIG. 1.
Figure 20:
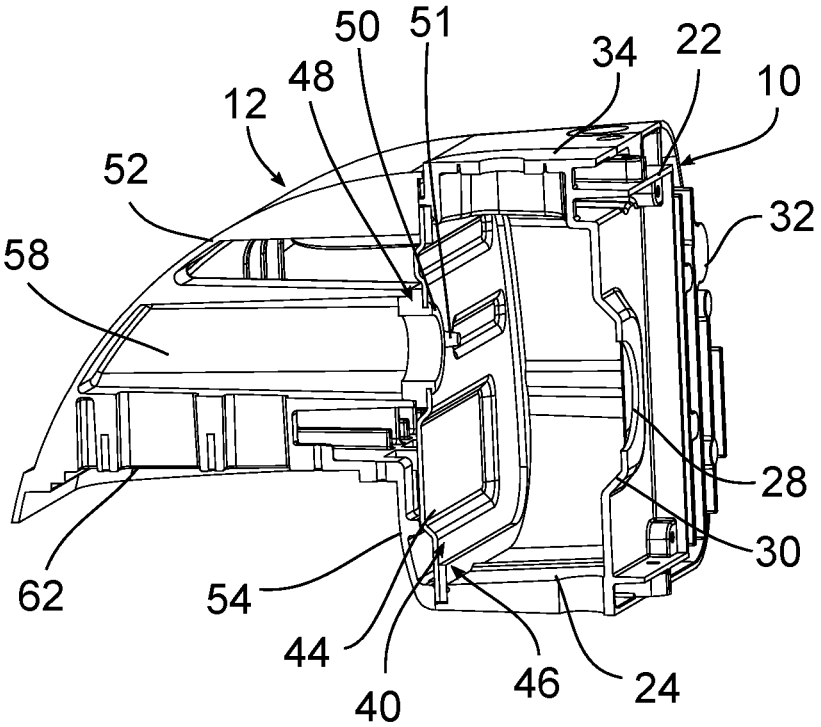
FIG. 20 is a side perspective, sectional view of FIG. 1.
Figure 21:
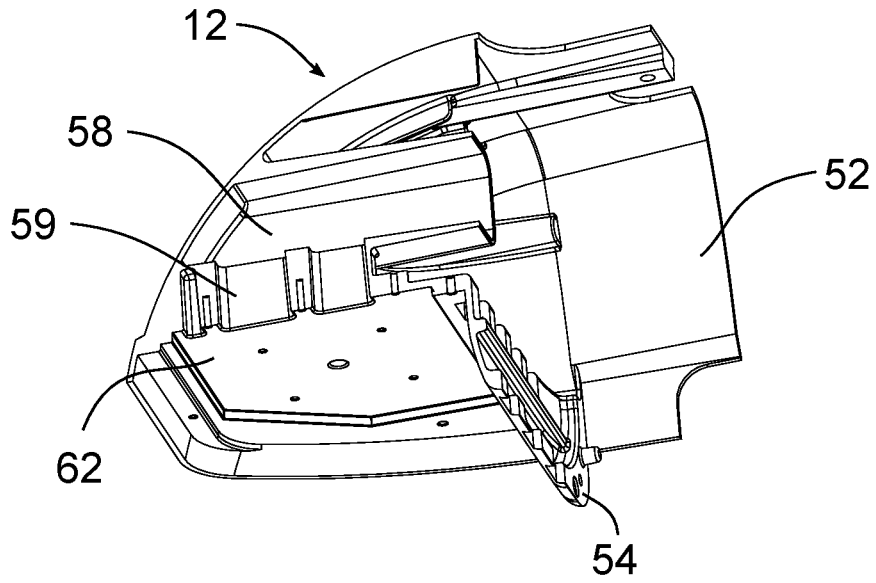
FIG. 21 is a side perspective, section view of FIG. 20.

FIG. 19 shows the divider 40 and the gaskets 46, 48 connected to the cover 12 and FIG. 20 shows these components connected with the housing 10. The gaskets 46, 48 are positioned between the divider with the conductor gasket 48 extending at least partially into the conductor channel 58. The tope edge of the cover 12 outer wall 52 extends at least partially over the top wall 22 of the housing 10 and the sides of the outer wall 52 at least partially overlap with the side walls 26 of the housing 10. The assembly helps provide a water-proof or water-resistant luminaire housing that is suitable for exposed, outdoor use.

Figure 22:
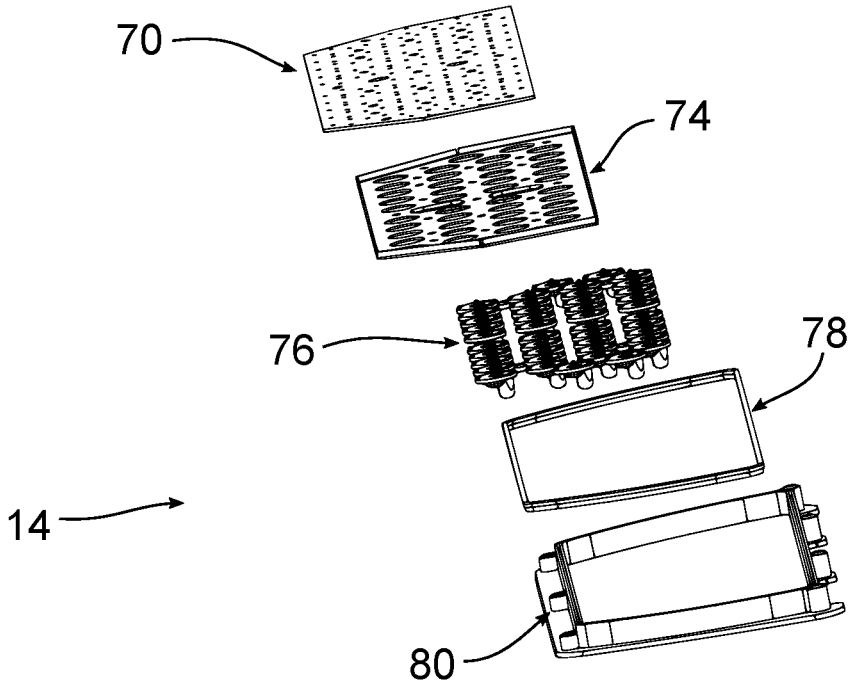
FIG. 22 is a side perspective view of an exemplary light assembly.

FIG. 22 shows an exemplary embodiment of a light assembly 14 that includes an LED board 70, a bezel 74, one or more optics 76, a lens gasket 78, and a lens 80. The LED board 70 includes a printed circuit board (PCB) and one or more light emitting devices, for example LEDs, connected to the PCB. The optics 76 can be connected to the PCB over the LEDs to direct or diffuse the emitted light. The LED board gasket 72 is positioned between the LED board 70 and the bezel 74 to seal and protect the LED board 70. The LED board gasket 72 can be made from a polymer or elastomer material, for example silicone, although other materials may be used. The bezel 74 can be made from a metal, although other materials may also be used. The lens 76 and lens gasket 78 can be connected to the LED board 70 or the bezel 74. The lens 76 is an optional component that can be connected depending on the desired use. The lens 76 can be colored and/or include light directing or diffusing elements such as prisms.

Figure 23:
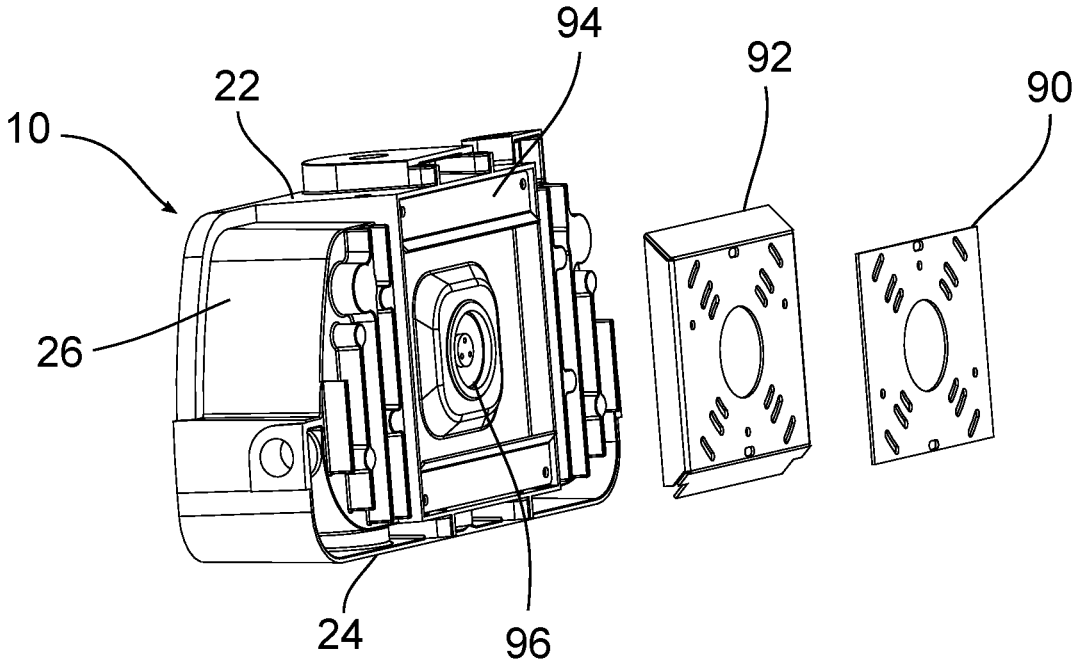
FIG. 23 is a rear perspective view of the housing of FIG. 1 and an exemplary mounting assembly.

FIG. 23 shows an exemplary mounting assembly associated with the housing 10 used to attach the luminaire to a structure, for example a wall, post, or other type of support. The mounting assembly includes a gasket 90, a mounting plate 92, and one or more mounting brackets 94. The mounting plate 92 and the gasket 90 include different openings to allow for different connections. The gasket 90 is placed against the structure and the mounting plate 92 is attached to the structure, for example through straps, bolts, screws, or other fasteners. The mounting bracket 94 is secured to the housing 10. The mounting plate 92 includes a base and one or more angled walls extending from the base. The mounting bracket 94 includes an angled tab that engages the angled walls of the mounting plate 92. After the mounting plate 92 is connected to a structure, the housing 10 can be positioned adjacent the mounting plate 92 and the angled tab of the mounting bracket 94 can engage the angled wall of the mounting plate 92. The angled surfaces allow the housing 10 to slide down onto the mounting plate 92, providing easier mounting and forming a close engagement with the structure. One or more set screws can be used to secure the mounting plate to the mounting bracket.

A housing conductor gasket 96 can be connected to the housing 10. The housing conductor gasket 96 is positioned in the recess 30 in the housing 10 around the conductor opening 28. The conductor opening 28 aligns with openings on the mounting plate 92 and the gasket 96 so that conductors can be feed into the housing 10. The housing conductor gasket 96 protects the conductors from wear and can also prevent water from entering the housing 10.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a housing for containing a light emitter control component;

a cover connected to the housing having an outer wall, a mounting section, a chamber, and a conductor channel positioned in the chamber and having a side wall and a bottom wall, the bottom wall having an opening in communication with the mounting section;

a divider positioned between the housing and the chamber and including a conductor opening in communication with the conductor channel;

and a light assembly connected to the mounting section and operatively connected to the control component.

2. The luminaire of claim 1, further comprising a conductor gasket connected to the divider.

3. The luminaire of claim 2, wherein the conductor gasket includes a flange extending through the conductor opening and a projection extending through the divider.

4. The luminaire of claim 1, wherein a sensor extends through the housing and is operably connected to the control component.

5. The luminaire of claim 4, wherein the housing includes a protrusion extending from the top wall and an opening through the protrusion receives at least a portion of the sensor.

6. The luminaire of claim 1, wherein the light assembly includes an LED board, a bezel, one or more optics, a lens gasket, and a lens.

7. The luminaire of claim 1, wherein an outer gasket is positioned between the divider and the cover.

8. The luminaire of claim 1, wherein a set of heat fins is positioned in the chamber.

9. A luminaire comprising:

a housing defining a cavity for containing a control component, the housing having a back wall, a top wall, a bottom wall, a pair of side walls, a protrusion and a housing opening extending through the protrusion to provide communication with the cavity;

a cover connected to the housing having an outer wall, a mounting section, a chamber, and a conductor channel positioned in the chamber and having a side wall and a bottom wall, the bottom wall having an opening in communication with the mounting section;

a divider positioned between the housing and the cover and including a conductor opening in communication with the conductor channel;

a light assembly connected to the mounting section and operatively connected to the control component; and a sensor connected to the housing and connected to the control component.

10. The luminaire of claim 9, wherein the conductor channel extends from a front portion of the outer wall toward a rear portion of the chamber and a passage extends between the conductor channel and the mounting section.

11. The luminaire of claim 9, wherein the protrusion extends from the top wall and the sensor is a photo-controller.

12. The luminaire of claim 9, wherein the protrusion extends from the bottom wall and the sensor is an occupancy sensor.

13. The luminaire of claim 9, wherein the outer wall includes a slot mating with the protrusion.

14. The luminaire of claim 9, wherein a portion of the outer wall overlaps at least a portion of the top wall and the side walls.

15. The luminaire of claim 9, further comprising a set of heat fins positioned in the chamber.

16. A luminaire comprising:

a housing including a back wall, a top wall, a bottom wall, an open front, and a pair of side walls extending from the back wall to the open front;

a cover connected to the housing having an outer wall, a mounting section, and a chamber, wherein a portion of the outer wall overlaps at least a portion of the top wall and the side walls, and a conductor channel positioned in the chamber and having a side wall and a bottom wall, the bottom wall having an opening in communication with the mounting section;

a divider positioned between the housing and the cover and including a conductor opening providing communication between the cover and the housing;

a control assembly positioned in the housing; and a light assembly connected to the mounting section and operatively connected to the control assembly.

17. The luminaire of claim 16, further comprising a conductor gasket connected to the divider and an outer gasket connected to the divider between the housing and the cover.

18. The luminaire of claim 16, further comprising a set of heat fins and a conductor channel positioned in the chamber.

19. The luminaire of claim 16, wherein the control assembly includes a driver and a sensor.

20. The luminaire of claim 16, wherein the housing includes a protrusion and the outer wall includes a slot mating with the protrusion.

* * * * *